US005207547A

United States Patent [19]

Kawamura

[11] Patent Number: 5,207,547

[45] Date of Patent: May 4, 1993

[54] PACKAGE REPLACING APPARATUS

[75] Inventor: Shuzo Kawamura, Joyo, Japan

[73] Assignee: Murata Kikai Kabushiki Kaisha, Kyoto, Japan

[21] Appl. No.: 512,962

[22] Filed: Apr. 23, 1990

[30] Foreign Application Priority Data

Aug. 2, 1989 [JP] Japan ..... 1-904436[U]
Aug. 16, 1989 [JP] Japan ..... 1-95534[U]
Aug. 25, 1989 [JP] Japan ..... 1-49330[U]

[51] Int. Cl.[5] ..... B65H 67/00

[52] U.S. Cl. ..... 414/331; 242/35.5 A; 414/908; 414/911; 414/280; 414/345

[58] Field of Search ..... 414/331, 280, 277, 279, 414/281, 282, 908, 911, 661, 222, 345, 347; 242/35 A

[56] References Cited

U.S. PATENT DOCUMENTS 3,811,631 5/1974 Mayer ..... 242/35.5 A X
3,987,974 10/1976 Mayer ..... 242/35.5 A
4,041,686 8/1977 Inaba et al. ..... 242/35.5 A X
4,555,215 11/1985 Raasch et al. ..... 414/331 X
4,669,942 6/1987 Nagasawa ..... 414/331
4,783,021 11/1988 Nagasawa ..... 414/331 X
4,810,155 3/1989 D'Agnola ..... 414/331
4,923,132 5/1990 Hirai et al. ..... 242/35.5 A
4,932,827 6/1990 Schlunke et al. ..... 414/280
4,988,252 1/1991 Yamamoto et al. ..... 414/331

FOREIGN PATENT DOCUMENTS 110275 6/1984 European Pat. Off. ..... 242/35.5 A
4716715 9/1972 Japan ..... 242/35.5 A
31671 2/1987 Japan ..... 242/35.5 A
2090341 4/1987 Japan ..... 242/35.5 A
1326531 7/1987 U.S.S.R. ..... 242/35.5 A
2152084 7/1985 United Kingdom ..... 242/35.5 A

*Primary Examiner*—Frank E. Werner
*Attorney, Agent, or Firm*—Spensley Horn Jubas & Lubitz

[57] ABSTRACT

A package replacing apparatus capable of running along a creel having a plurality of pegs comprising a fitting unit for putting packages on the pegs and a pull-off unit for pulling off bobbins from the pegs, wherein the fitting unit includes a plurality of package support members which are supported by sleeves vertically movable and rotatably put on a vertically movable rod and the pull-off unit includes a plurality of robot hands provided at the corresponding position to the pegs.

4 Claims, 13 Drawing Sheets

PACKAGE REPLACING APPARATUS

FIELD OF THE INVENTION

The present device relates to an apparatus for putting a cylindrical body, such as a cylindrical yarn package having ends of bobbins projecting from its opposite ends, on a horizontal peg and an apparatus for replacing bobbins fitted on pegs.

RELATED ART STATEMENT

Manual work has been the only means for putting cylindrical yarn packages on a horizontal pegs vertically arranged at fixed intervals because of the following reasons. In putting a cylindrical yarn package on a peg, the cylindrical yarn package must be positioned with its relatively small bore, for example, a bore of 8 mm in diameter, in alignment with the free end of the peg, a plurality of pegs must highly correctly be arranged in a horizontal position in a vertical arrangement at fixed intervals on a frame, and a robot hand holding the cylindrical yarn package must be positioned at a very high accuracy relative to the horizontal peg. Equipment and control for carrying out such a method of putting a yarn package on a peg are excessively costly as compared with manual work for the same purpose.

The inventors of the present invention found that the development of an inexpensive positioning mechanism for positioning a cylindrical yarn package with its axis in alignment with the free end of a peg is a matter calling for prior settlement to replace the manual work by an automated means. The present device has been made through the successful development of such a positioning mechanism.

OBJECT AND SUMMARY OF THE INVENTION

It is an object of the present invention to provide an inexpensive positioning apparatus for positioning a cylindrical package with its axis in alignment with the free end of a peg.

It is another object of the present invention is to provide a package replacing robot which is capable of replacing the packages easily even where the pegs are arranged in a staggered pattern.

According to one embodiment of the present invention it is proposed an apparatus for putting a package on a peg comprising a vertically movable rod supported on a horizontally movable carriage, a sleeve vertically movable and rotatably put on the vertically movable rod, said sleeve supporting a cam follower, a tube holding frame having a pair of opposite arms each provided with a recess for receiving the tube thereon and supported by the sleeve, and a peg guide provided a V-shaped notch and supported one of the opposite arms nearer to the peg so that the axis on the side of the peg of a package received in the recesses and the axis of the free end of the peg seated on the bottom of the notch coincide with each other.

According to another embodiment of the present invention, a package replacing robot which is capable of replacing the package even where the pegs are arranged in a staggered pattern is proposed. The package replacing robot comprises a car truck capable of running along a creel comprising pegs at a multiplicity of vertical levels and in a plurality of rows, a pull-off unit for pulling off bobbins with residual yarn thereon from the pegs in a desired row onto the car truck, and a fitting unit for fitting packages to the pegs in the row next to the desired row, wherein the pull-off unit and the fitting unit are provided on the car truck so that the height of each of the units is switchable through a switching mechanism so as to conform each of the units to the pegs in each row.

When the car truck is stopped at the position of the pegs on the creel at which package replacement is to be performed, the height of each unit is switched by the switching mechanism so as to conform each of the units to the pegs in each row. It is thereby possible to easily replace the packages, not only where the pegs are arranged in a grid pattern (namely, at intersections of equally spaced horizontal lines and equally spaced vertical lines) but also where the pegs are arranged in a staggered pattern.

DETAILED DESCRIPTION OF PREFERRED EMBODIMENT

A preferred embodiment of the present invention will be described hereinafter with reference to the accompanying drawings. In the following description, the term "front" is used to modify those on the lower side in FIG. 1, the term "rear" is used to modify those on the upper side in FIG. 1, the term "left" is used to modify those on the left-hand side in FIG. 1 and the term "right" is used to modify those on the right-hand side in FIG. 1.

Figure 1:
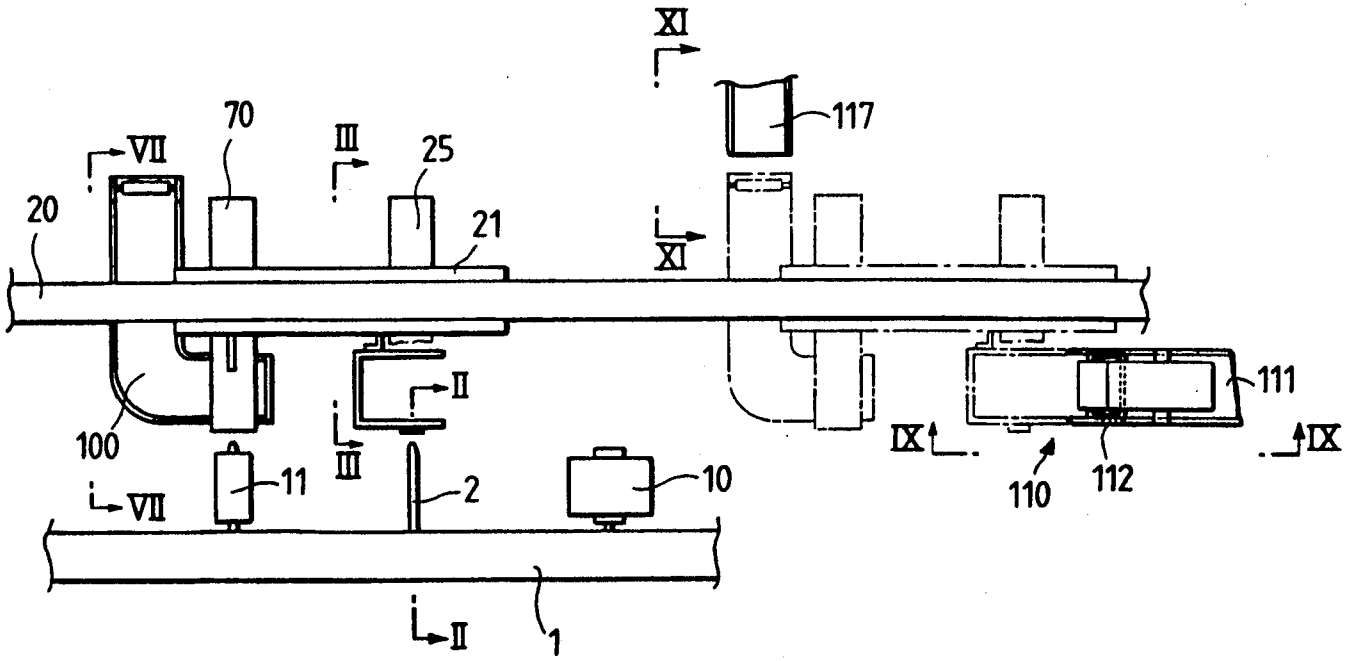
FIG. 1 is a partly broken, schematic plan view of an apparatus embodying the present invention.
Figure 4:
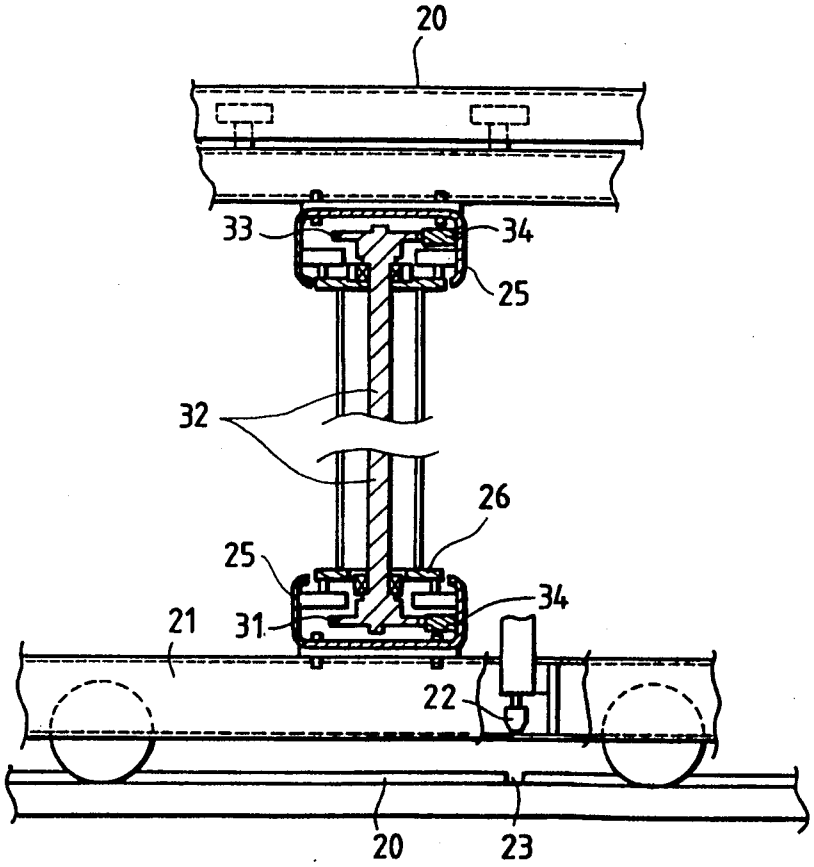
FIG. 4 is a sectional view taken on line IV—IV in FIG. 3, in which the middle portion is omitted.
Figure 2:
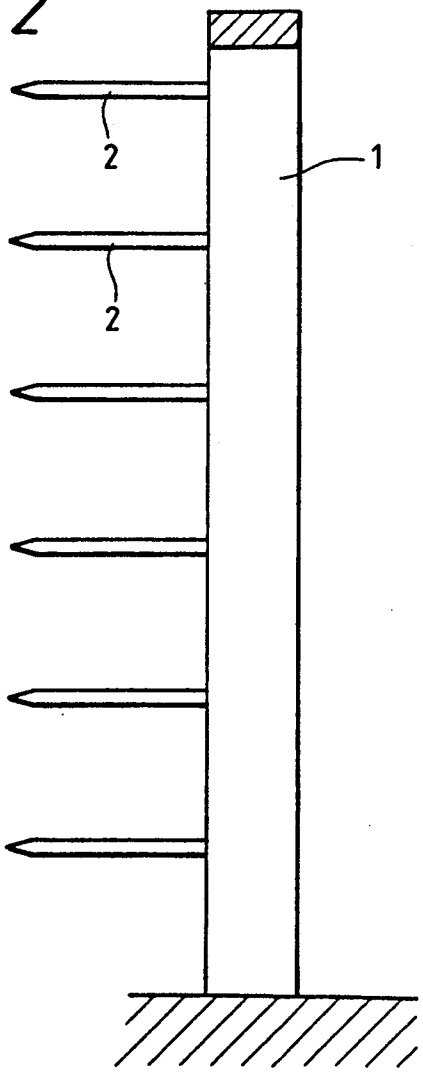
FIG. 2 is an enlarged sectional view taken on line II—II in FIG. 1.
Figure 3:
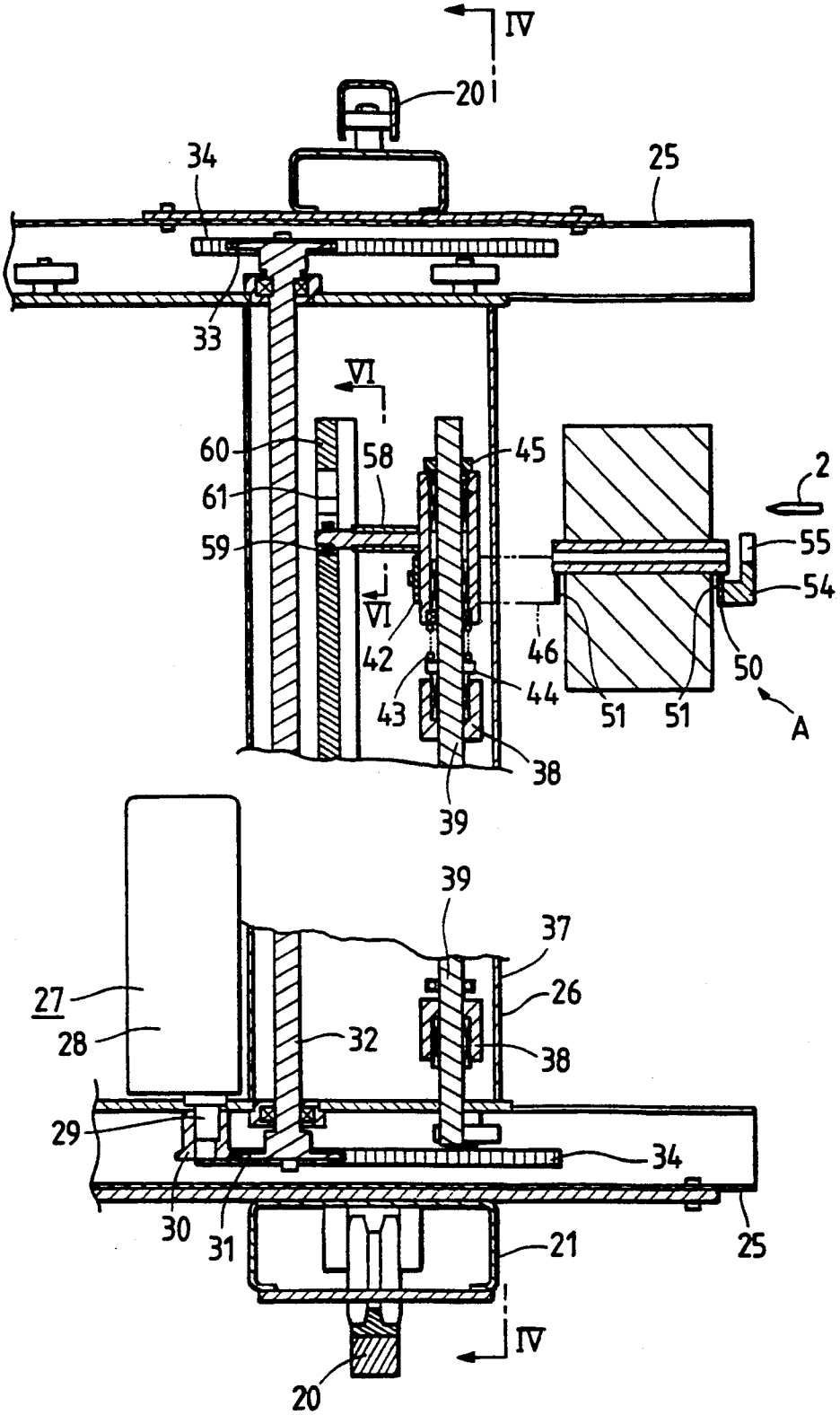
FIG. 3 is an enlarged sectional view taken on line III—III in FIG. 1.

Referring to FIGS. 1 and 2, a plurality of pegs 2 are arranged in rows and lines in a horizontal position on a frame 1 with their free ends directed toward the rear side. A yarn package 10 formed by winding a yarn on a bobbin so that the opposite ends of the bobbin project from the opposite ends of the yarn layers, respectively, is put on each peg 2. The yarn packages 10 feed yarns as warp yarns to a loom, not shown, disposed on the left-hand side of the frame 1. After the yarn package 10 has exhausted, the empty bobbin 11 is removed from the peg 2.

As shown in FIGS. 1, 3, 4, 5 and 6, a pair of guide rails 20, namely, upper and lower guide rails 20, are extended laterally on the side of the free ends of the pegs 2, namely, behind the pegs 2, to guide a truck 21 for lateral movement. The truck 21 is driven by a motor, not shown, for lateral movement. The truck 21 is provided with a retractable positioning pin (FIG. 4), and a positioning recess 23 is formed in the lower guide rail 20 to position the truck 21 at its stopping position. The positioning pin 22 engages the positioning recess 23 to stop the truck 21 at a set position.

The truck 21 is provided with a pair of first guide rails 25, namely, upper and lower guide rails, extended perpendicularly to the guide rails 20 to guide a first carriage 26 for movement toward and away from the frame 1. The first carriage 26 is moved by a driving unit 27 provided with a motor 28. A pinion 30 attached to the output shaft 29 of the motor 28 engages a gear 31 attached to the lower end of a vertical shaft 32 journaled on the carriage 26. A gear 33, which is identical with the gear 31, is attached to the upper end of the vertical shaft 32. The gears 33 and 31 engage upper and lower racks 34 extended in parallel to and fixed to the first guide rails 25, respectively. The output shaft 29 of the motor 28 is rotated in the normal direction of the reverse direction to move the first carriage 26 in a desired direction.

Figure 5:
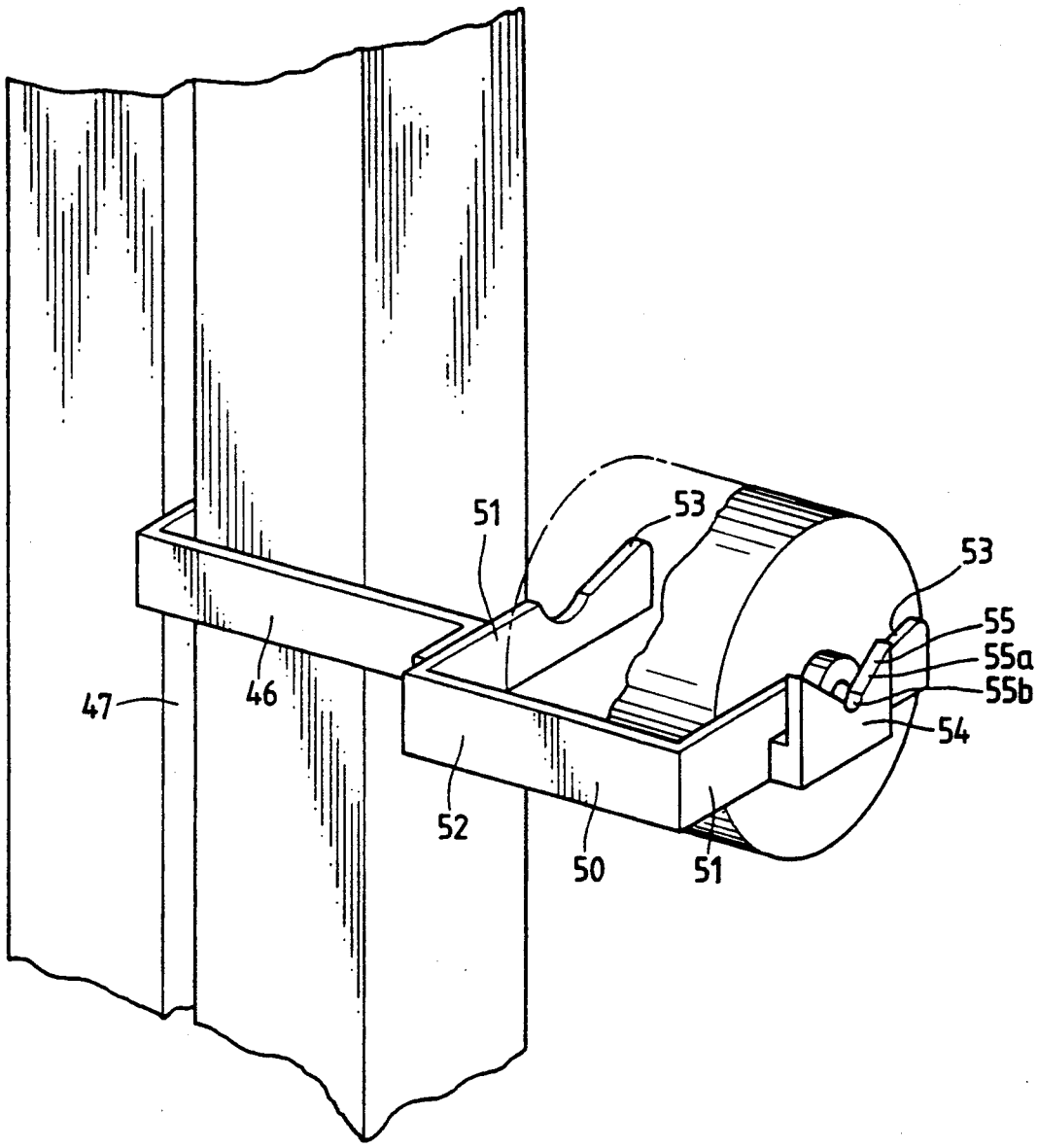
FIG. 5 is an enlarged perspective view of a portion indicated at A in FIG. 3.

At least two bearings 38 are attached to a hollow post 37 included in the first carriage 26 with their axes in vertical position and in alignment with each other. A vertical lifting rod 39 is supported for vertical movement in the bearings 38. The vertical lifting rod 39 is moved for vertical movement by a lifting mechanism, not shown. A plurality of sleeves 42 are mounted on the vertical lifting rod 39 for both vertical movement and turning. The number of the sleeves 42 is equal to that of the peg on a vertical row. The sleeves 42 are arranged so as to correspond respectively to the pegs 2 and are urged upward by springs 43 which are not strained by the weight of the yarn package 10. Each spring 43 has a lower end seated on a spring seat 44 fixed to the vertical lifting rod 39. The upper end of the sleeve 42 urged upward by the spring 43 is in abutment with a stopper 45 fixed to the vertical lifting rod 39. The sleeve 42 is provided with a bracket 46 projecting outward from the post 37 through a vertical slit formed in the post 37. A yarn package support member 50 having a connecting portion 52 and a pair of opposite support arms 51 projecting from the opposite ends of the connecting portion 52, which are combined integrally in a shape resembling the letter U, is attached to the extremity of the bracket 46 with its opposite support arms 51 extended perpendicularly to the peg 2 and its connecting portion 52 on the left-hand side. The yarn package support members 50 and peg guide members 54, which will be described afterward, are separated from the yarn packages 10 supported on the pegs, when the vertical lifting rod 39 is at the lowermost position. The width between the inner surfaces of the support arms 51 is slightly greater than that of the yarn layers of the yarn package 10. Recesses 53 are formed in the respective upper sides of the opposite support arms 51 of the yarn package support member 50 near the extremities of the support arms 51, respectively. The peg guide member 54 provided with a V-shaped notch 55 is provided on the support arm 51 corresponding to the extremity of the peg 2. The peg support member 54 is located below the peg 2 when the vertical lifting rod 39 is at the lowermost position, and is located in front of the extremity of the peg 2 when the first carriage 26 is at the rearmost position. The notch 55 has upper peg guiding surfaces **55*a* and a lower peg receiving surface 55*b* (FIG. 5). When the free end of the peg 2 is seated on the peg receiving surface 55*b*, the axis of the free end of the peg 2 is aligned with the axis of the end of the yarn package 10 supported on the recesses 53 on the side of the peg 2. The peg guide member 54 is positioned under the free end of the peg 2 and the vertical lifting rod 39 is raised to receive the extremity of the peg 22 on the peg receiving surface 55*b*, so that the extremity of the yarn package 10 supported on the recesses 53 on the side of the peg 2 is aligned automatically with the axis of the free end of the peg 2. Even if the peg receiving surface 55*b* is dislocated horizontally to some extent relative to the peg 2, the peg guiding surface 55*a* comes into contact with the peg 2 when the vertical lifting rod 39 is raised and as the vertical lifting rod 39 is raised further, the yarn package support member 50 turns horizontally on the vertical lifting rod 39 so that the peg 2 drops on the peg receiving surface 55*b*. Thus, the slight horizontal dislocation of the peg receiving surface 55*b* relative to the peg 2 is permissible. Even if the vertical position of the yarn package support member 50 or the peg guide member 54 is dislocated to some extent relative to the vertical position of the peg 2, the sleeve 42 axially movably mounted on the vertical lifting rod 39 is depressed by the peg 2 against the resilience of the spring 43 by a distance corresponding to the difference between the vertical position of the peg guide member 54 and that of the peg 2 as the vertical lifting rod 39 is raised. Thus all the pegs 2 in a vertical row can be seated on the peg receiving surfaces 55*b* of the corresponding peg guide members 54**.

A horizontal arm 58 projects from the sleeve 42 in a direction opposite to the direction of extension of the bracket 46, and a roller 59 serving as a cam follower is supported rotatably on the extremity of the horizontal arm 58. The roller 59 is fitted in a vertically elongate cam slot 61 (FIG. 6) formed in a positioning plate 60 provided on the first carriage 26. The cam slot 61 has an upper portion allowing the lateral movement of the roller 59 and a lower portion restraining the roller 59 from lateral movement. The cam slot 61 is formed and disposed so that the roller 59 is in the lower portion **61*b* when the vertical lifting rod 39 is at the lowermost position, the roller 59 enters the upper portion 61*a* and is allowed to move laterally when the vertical lifting rod 39, hence the peg guiding member 54, is raised and an imaginary plane including its upper end coincide with the peg 2, and the roller 59 is not in contact with the upper end of the upper portion 61*a* when the peg 2 is seated on the peg receiving surface 55*b***.

Figure 7:
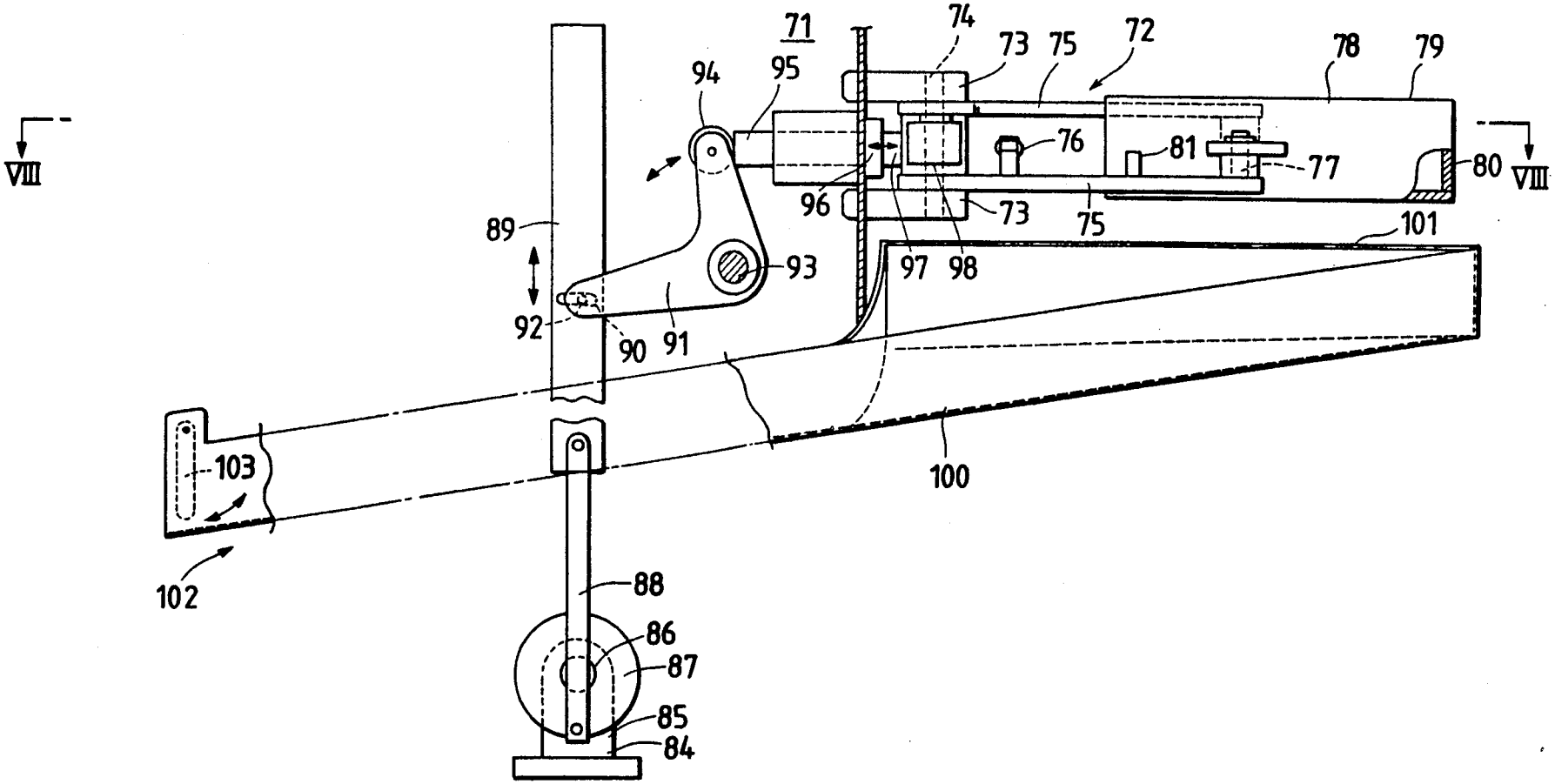
FIG. 7 is an enlarged sectional view taken on line VII—VII in FIG. 1 showing an essential portion of the apparatus.
Figure 8:
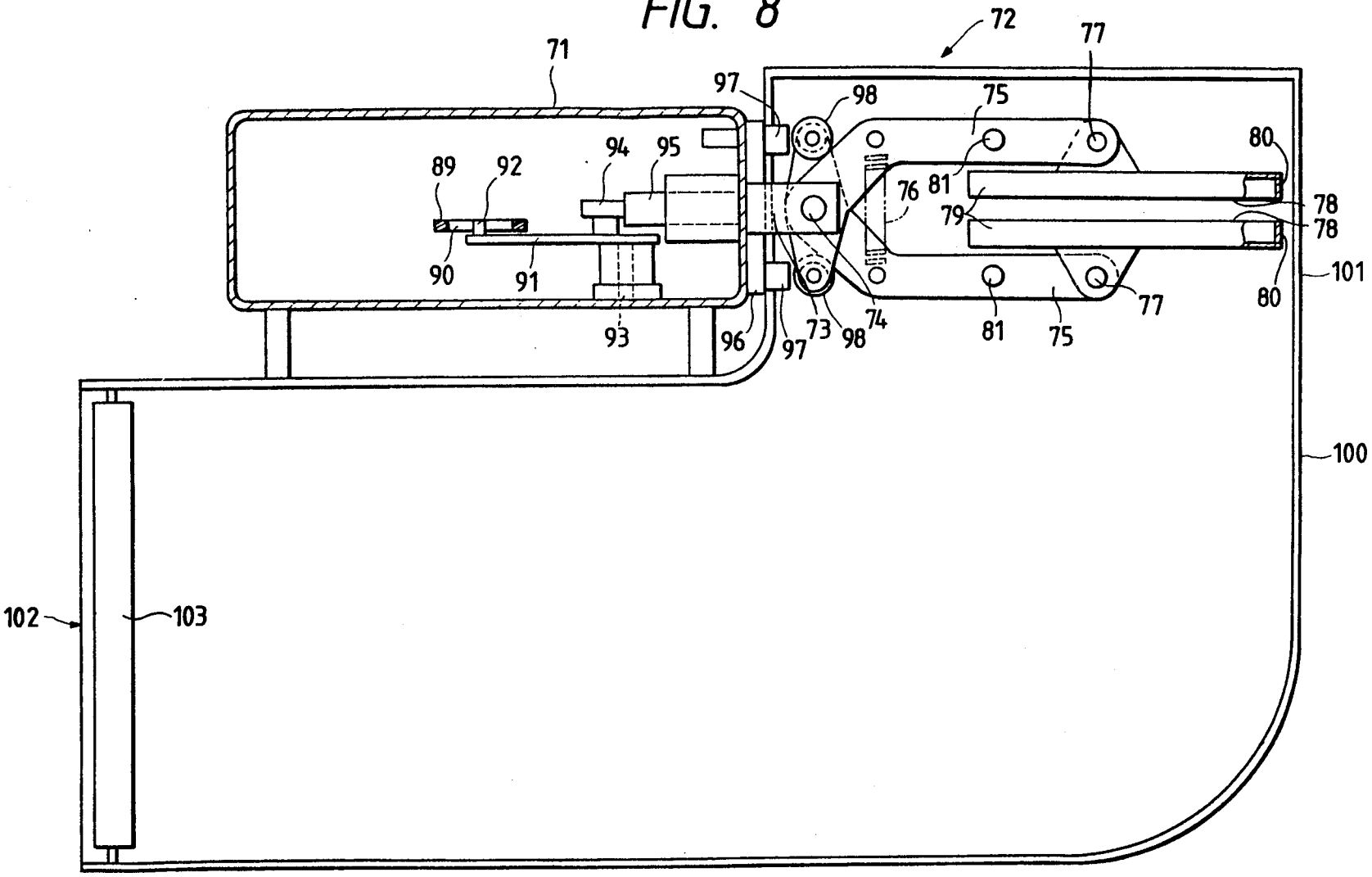
FIG. 8 is a sectional view taken on line VIII—VIII in FIG. 7.

As shown in FIGS. 1, 7 and 8, the truck 21 is provided with a pair of second guide rails 70, namely, upper and lower guide rails, extended perpendicularly to the guide rail 20, and a second carriage 71 is supported for movement to the front and to the rear on the second guide rails 70. A driving mechanism, not shown, for driving the second carriage 71 is similar to that for driving the first carriage 26. Robot hands 72 are provided in a vertical arrangement on the second carriage 71 so as to correspond respectively to the pegs in a vertical row. The number of the robot hands 72 is equal to that of the peg 2 in a vertical row. The distance between the axis of horizontal swing motion of the robot hand 72, namely, the axis of a pivot pin 74, which will be described afterward, and the axis of the peg receiving surface **55*b* when the vertical lifting rod 39 is at the lowermost position corresponds to the horizontal pitch of the pegs 2. Each robot hand 72 has a pair of swing members 75 pivotally supported on the pivot pin 74 with its axis extended vertically. The swing members 75 are biased toward each other with a spring 76. Bobbin holding members 78 are supported for horizontal swing motion on the extremities of the swing members 75 with pivot pins 77, respectively. Each bobbin holding member 78 has a semicylindrical body 79 and a semicircular retainer 80 provided on the extremity of the body 79. Stoppers 81 are provided on the swing members 75, respectively, to limit the movement of the extremities of the bobbin holding members 78 provided with the retainers 80 toward each other beyond a set distance. The robot hand 72, practically, the swing members 75, are operated by an operating mechanism 84. A motor 85 is mounted on the second carriage 71, a rotary disk 87 is mounted fixedly on the output shaft 86 of the motor 85, a rod 88 has a lower end pivotally joined to the periphery of the rotary disk 87, and an upper end pivotally joined to the lower end of a lifting rod 89 provided for vertical movement on the second carriage 71 and provided with horizontal slots 90 respectively for the robot hands 72, a bell crank 91 pivotally supported with a pivot pin 93 provided on the second carriage 71 with its axis in parallel to the lateral direction, and having one arm provided with a pin 92 received in the horizontal slot 90 and the other arm provided with a roller 94 having an axis included in a plane passing the middle of the pivot pin 74, a rod 95 extended with its rear end, namely, the end remote from the robot hand 72, in contact with the roller 94, a horizontal plate 96 attached to the front end, namely, the end near the robot hand 72, of the rod 95, with its longer sides extending in parallel to the lateral direction and provided at its opposite ends with projections 97, and rollers 98 pivotally supported opposite to the projections 97 on the bent rear ends of the swing members 75 with their axis extended vertically, respectively. The rollers 98 are pushed by the projections 97 to swing the swing members 75, hence the package holding members 78, away from each other. The projections 97 are retracted from the rollers 98 to allow the swing members 75, hence the package holding members, to be swung toward each other. A chute 100 is provided on the second carriage 71 under each robot hand 72 so that the chute 100 may not interfere with the pegs 2 and empty bobbins 12 put on the pegs 2. The chute 100 has a bobbin inlet 101 at a position corresponding to the robot hand 72, and a bobbin outlet 102 at its front end. The bobbin outlet 102 is provided with a gate 103 which is operated to open or close the bobbin outlet 102** by a fluid cylinder actuator, not shown, or the like.

Figure 9:
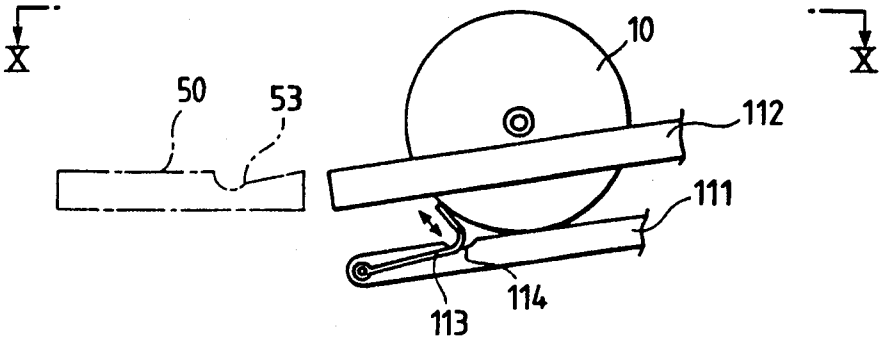
FIG. 9 is an enlarged sectional taken on line IX—IX in FIG. 1 of an essential portion of the apparatus.
Figure 10:
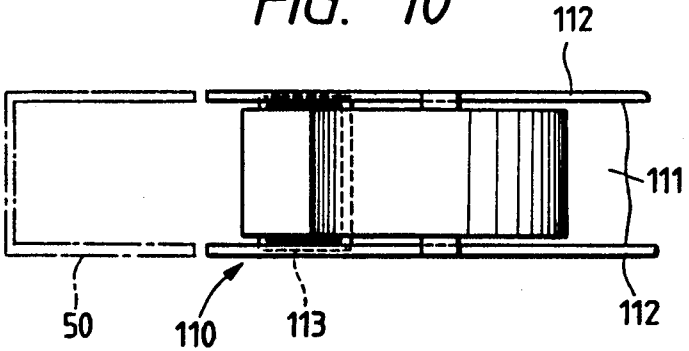
FIG. 10 is a sectional view taken on line X—X in FIG. 9.

As shown in FIGS. 1, 9 and 10, a yarn package supply station 110 is disposed on the right-hand side of the frame 1. The yarn package supply station 110 is provided with a chute 111 declining to the right so as to be positioned opposite to each yarn package holding member 50. A pair of guide plates 112 are extended above the opposite sides of the chute 111, respectively. The distance between the respective inner surfaces of the guide plates 112 is equal to or substantially equal to the distance between the inner surfaces of the opposite support arms 51. The truck 21 is stopped at a position where a yarn package 10 can be transferred from the extremity of the chute 111 to the opposite support arms 51 so that the opposite ends of the bobbin projecting from the yarn package 10 are supported on the opposite support arms 51, respectively; that is, the truck 21 is stopped at a position where the opposite ends of the bobbin projecting from the yarn package 10 discharged through the extremity of the chute 111 do not fall under the opposite support arms 51. When the truck 21 is stopped at such a position, the vertical lifting rod 30 is at the lowermost position and the first carriage 26 is at the rearmost position, namely, a position remotest from the frame 1. A stopper 113 which is caused to swing in a vertical plane by a fluid cylinder actuator, not shown, or the like is disposed near the extremity of the chute 111. Spaces 114 are formed in the chute 111 to receive the horizontal portions of the stopper 113.

Figure 11:
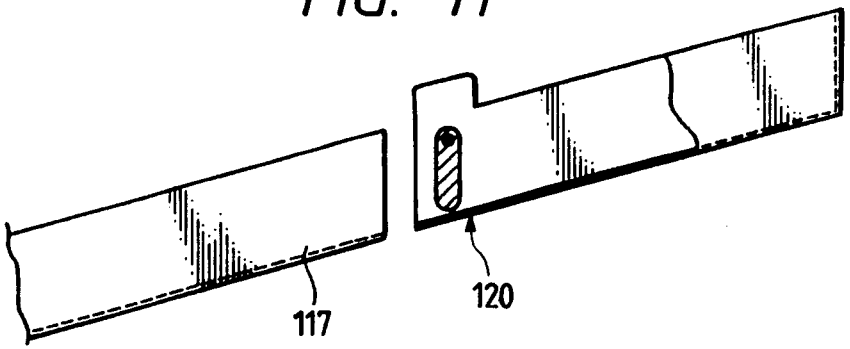
FIG. 11 is an enlarged sectional view taken on line XI—XI in FIG. 1.
Figure 6:
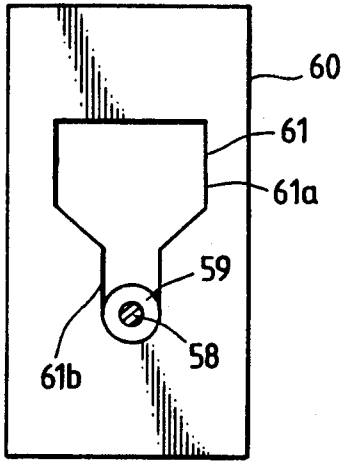
FIG. 6 is an enlarged sectional view taken on line VI—VI in FIG. 3.

As shown in FIGS. 1 and 11, a-discharge chute 117 is disposed so as to be aligned with the bobbin outlet of the chute 100 when the truck 21 is stopped at the yarn package receiving position to receive a yarn package 10 from the chute 111.

The functions of the apparatus embodying the present device will be described hereinafter.

Figure 12A:
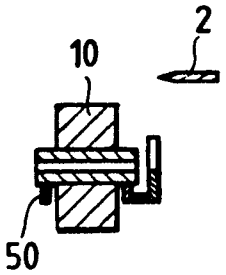
FIGS. 12*a* to 12*h* are illustrations of assistance in explaining the functions of an essential portion of the apparatus.
Figure 12B:
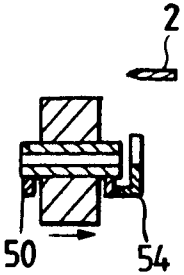
Figure 12C:
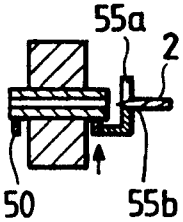

First, an operation for putting a yarn package 10 on the peg 2 will be described. The positioning pin 22 engages the recess 23 when the truck 21 is stopped and the positioning pin 22 is retracted from the recess 23 before the truck 21 starts traveling, the description of which is omitted. The truck 21 is moved to and stopped at a position on the left side of the chute 111 to receive the opposite ends of the bobbin projecting from the opposite ends of a yarn package 10 discharged through the extremity of the chute 111 on the opposite support arms 51 of the empty yarn package support member 50. In this state, the vertical lifting rod 39 (the yarn package support member 50) is at its lowermost position and the first carriage 26 is at its rearmost position remotest from the pegs 2. Then, the stopper 113 is lowered to release the top yarn package 10. The stopper 113 is raised immediately after releasing the top yarn package 10 to stop the second yarn package 10 and the following ones. The released yarn package 10 slides down along the chute 111 into the recesses 53. Then, the truck 21 travels to a position corresponding to an empty peg 2 and is stopped at the set position where the axis of the yarn package 10 coincides with that of the peg 2. In this state, the peg guide member 54 is positioned in front of the peg 2 (FIG. **12*a*). Subsequently, the vertical lifting rod 39 (the yarn package support member 50) is raised from the lowermost position to seat the free end of the peg 2 on the peg receiving surface 55*b*. The peg 2 reaches the peg receiving surface 55*b* directly or along the peg guide surface 55*a* (FIG. 12C). Positional errors of the peg 2 is absorbed, as mentioned above, by the free horizontal turning and free axially downward shift of the yarn package support member 50. Thus, the axis of the one end of the yarn package 10 near the peg 2 and that of the free end of the peg 2** are brought into alignment.

Figure 12D:
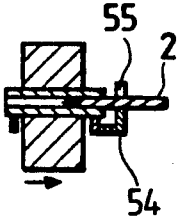
Figure 12E:
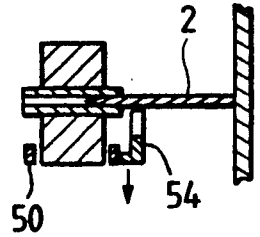
Figure 12F:
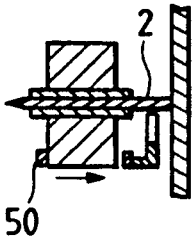
Figure 12G:
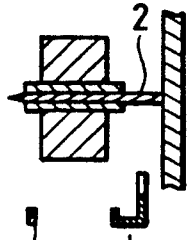
Figure 12H:
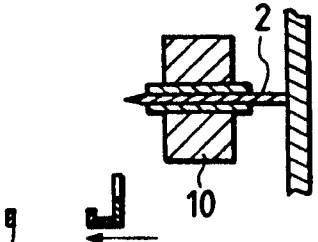

Subsequently, the first carriage 26 (the yarn package support member 50) is advanced through a small distance toward the peg 2 to receive the free end of the peg 2 in the yarn package 10 to support the yarn package 10 on the peg 2 (FIG. 12*d*). Then, the vertical lifting rod 39, hence the yarn package support member 50, lowered slightly to separate the peg guiding member 54 from the peg 2 (FIG. 12*e*). Then, the first carriage 26 is advanced further toward the peg 2 pushing the yarn package 10 with the opposite support arms 51 to put the yarn package 10 in place on the peg 2 (FIG. 12*f*). Then, the vertical lifting rod 39 is lowered to the lowermost position to retract the yarn package support member 50 and the peg guiding member 54 to a position under the yarn package 10 supported on the peg 2 (FIG. 12*g*), and then the first carriage 26 is moved away from the peg 2 (FIG. 12*h*).

An operation for removing empty bobbins 11 will be described hereinafter. The operation for removing empty bobbins 11 is carried out simultaneously with the operation for mounting yarn packages 10 on the pegs 2 without interfering the latter operation.

The truck 21 is moved to the position on the left side of the chute 111 to position the chute 100 in alignment with the discharge chute 117. Then, the gate is opened to discharge an empty bobbin 11 stored on the chute 100 onto the discharge chute 117. In this state, the second carriage 71 (the robot hand 72) is at the rearmost position remotest from the peg 2. Then, the gate 103 is closed and the first carriage 26 is moved to position the robot hand 72 at a position opposite to the peg 2 supporting an empty bobbin 11. This position corresponds to the position for putting the yarn package 10 on the peg because the distance between the center of the robot hand 72 with respect to the lateral direction and the axis of the peg receiving surface 55*b* when the vertical lifting rod 39 is at the lowermost position is equal to the pitch of the pegs 2 in a horizontal line. The second carriage 71 is advanced toward the peg 2 with the bobbin holding members 78 separated from each other, and the second carriage 71 is stopped at a position where the bobbin holding members 78 extend over the empty bobbin 11. Then, the bobbin holding members 78 are moved toward each other to hold the empty bobbin 11, and then the second carriage 71 is moved away from the peg 2 to remove the empty bobbin 11 from the peg 2. Subsequently, the bobbin holding members 78 are moved away from each other to drop the empty bobbin onto the chute 100. The empty bobbin 11 is stopped at the outlet 120 by the gate 103. Then, the truck 21 is moved to the position on the left side of the chute 111 to position the chute 100 in alignment with the discharge chute 117, the bobbin 11 is discharged from the chute 100.

The present invention thus constructed has the following effects.

Since the inexpensive positioning mechanism brings the respective axes of the free end of the peg and the cylindrical body into alignment, the horizontal pegs need not be attached correctly to the frame at a high accuracy, and the cylindrical body support member supporting the cylindrical body need not be positioned at a very high accuracy. Accordingly, the work for putting the cylindrical body on the peg can be automated at a relatively low cost.

Next, an improvement in a package replacing robot for replacement of bobbins which carry a residual yarn thereon and are fitted on pegs of a creel used for a warper or the like, by packages will be described.

Figure 16:
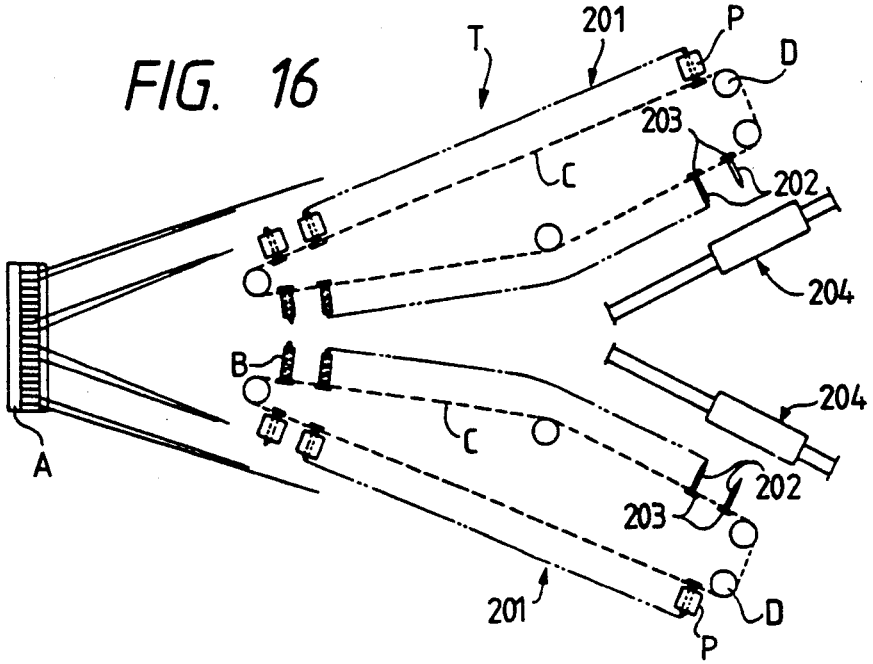
FIG. 16 is a schematic plan view of a warper.

In order to supply simultaneously a multiplicity of warps to a loom, there has been conventionally used a warper T as shown in FIG. 16. On the rear side of the warper T, two creels 201 are disposed in a V-shaped layout.

The creel comprises a multiplicity of creel frames 203, on which pegs 202 for fitting packages P thereon are provided at a multiplicity of vertical levels. The creel frames 203 are connected together horizontally through an endless chain C, which is engaged with front and rear sprockets D so that the chain C can be circulatively moved. In the creel 201, when the amounts of yarn in the packages P located on the back side are reduced, the packages P are sequentially fed to the back side. Then, a yarn splicing operation is carried out for cutting off the yarns from the packages P and connecting the cut yarns to yarns on new packages P located on the face side, and a package replacing operation is carried out for pulling off the bobbins B carrying the residual yarns thereon, after the cutting, from the pegs 202 and fitting the new packages onto the pegs 202. The package replacing operation, especially, has been carried out manually and, therefore, has required much labor.

In view of the above-mentioned circumstances, the applicant of this invention has hereinbefore disclosed a package replacing robot for automatically carrying out the above-mentioned package replacing operation. The robot is disposed to be capable of running along a creel on the back side, and comprises a pull-off unit for pulling off the bobbins with residual yarn thereon, in a batch manner on the basis of a creel frame basis, and a fitting unit for fitting the packages in a batch manner on a creel frame basis, the two units being disposed in parallel to each other. It is possible, by the robot, to replace the packages speedily.

Figure 17A:
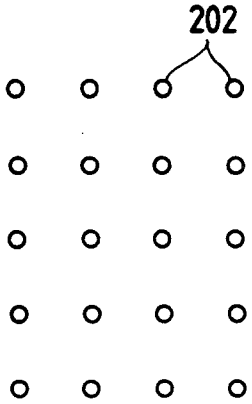
FIGS. 17*a* and 17*b* illustrate a layout of pegs.
Figure 17B:
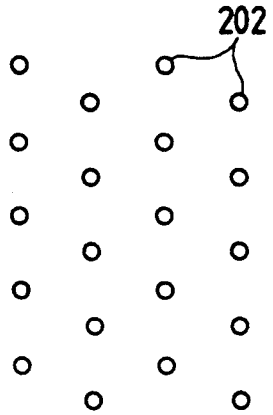

The above-mentioned robot, however, has drawbacks as follows. The construction having the pull-off unit and the fitting unit at the same height has no problem where the pegs are arranged in a grid pattern (namely, at intersections of equally spaced horizontal lines and equally spaced vertical lines), as shown in FIG. 17*a*; however, where the pegs are arranged in a staggered pattern, as shown in FIG. 17*b*, it is difficult to achieve package replacement, due to the height mismatch between the units and the pegs. In such a case, adoption of a combination of a robot conforming to the pegs in odd rows and a robot conforming to the pegs in even rows may be contemplated, but the combination is impracticable because of the impaired running properties of the robots.

In view of the above, another embodiment of the present invention relates to a package replacing robot which is capable of replacing the packages easily even where the pegs are arranged in a staggered pattern.

The embodiment will now be described in detail below, based on the accompanying drawings.

Figure 13:
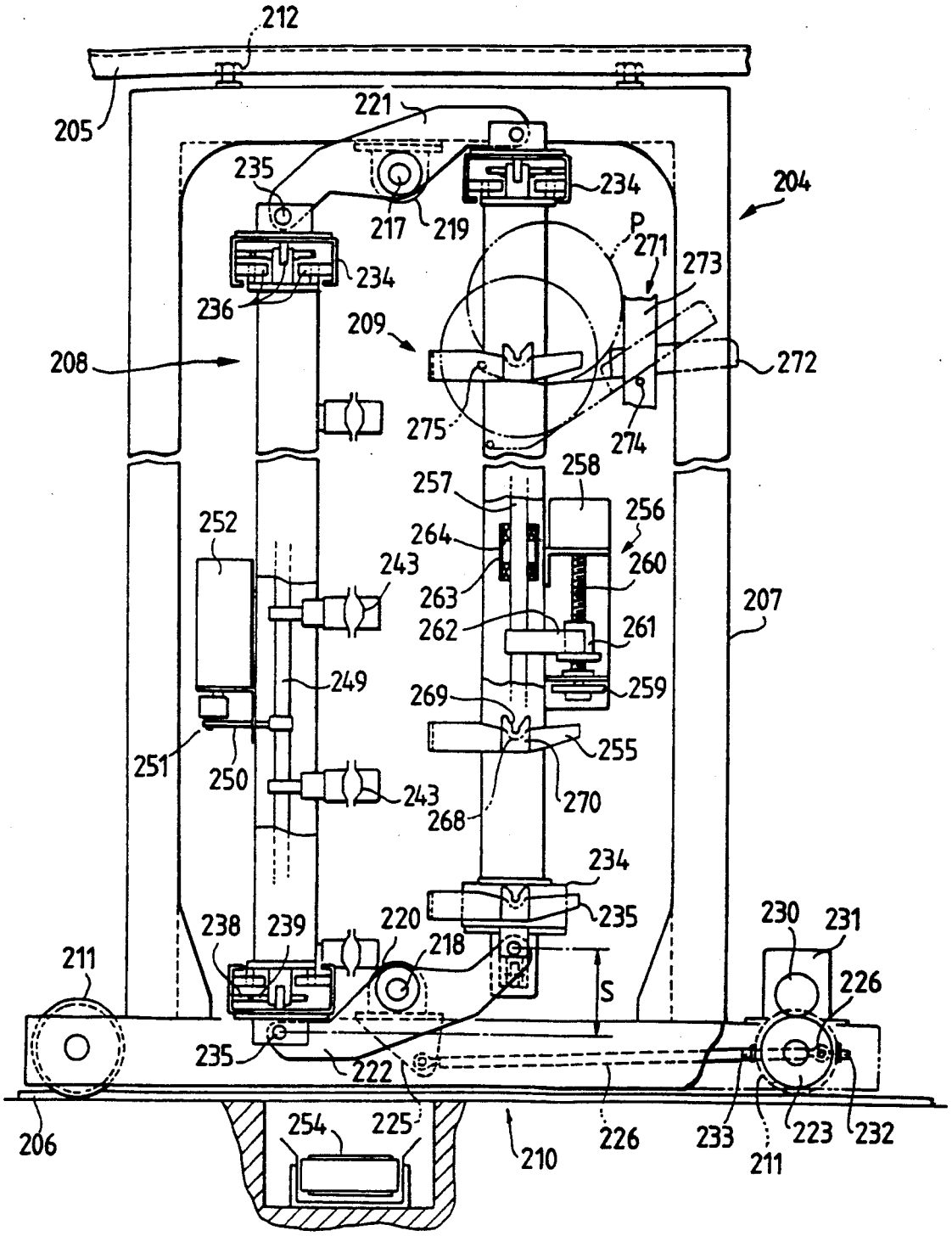
FIGS. 13 is a front view of a package replacing robot illustrating another embodiment of this invention.

Referring to FIG. 13, there is shown a circulative-type creel 201 of a warper, in which a multiplicity of creel frames 203 each comprising pegs 202 at a multiplicity of vertical levels are connected together horizontally at a predetermined pitch through an endless chain, not shown. The pegs 202 in the adjacent creel frames 203 are arranged in a staggered pattern, namely, with a vertical positional shift therebetween. On the peg projection side of the creel 201, a package replacing robot 204 is disposed to be capable of being reciprocated within a predetermined range along the direction of the circulative movement of the creel 201. The robot 204 comprises a car truck 207 supported to be capable of running along upper and lower rails 205 and 206. The car truck 207 is equipped with a pull-off unit 208 for pulling off bobbins B with residual yarn thereon in a batch manner on the basis of the creel frame 203, and a fitting unit 209 for fitting the packages P in a batch manner on the basis of the creel frame 203, the units 208 and 209 being so mounted that the heights thereof are switchable through a switching mechanism 210.

Figure 14:
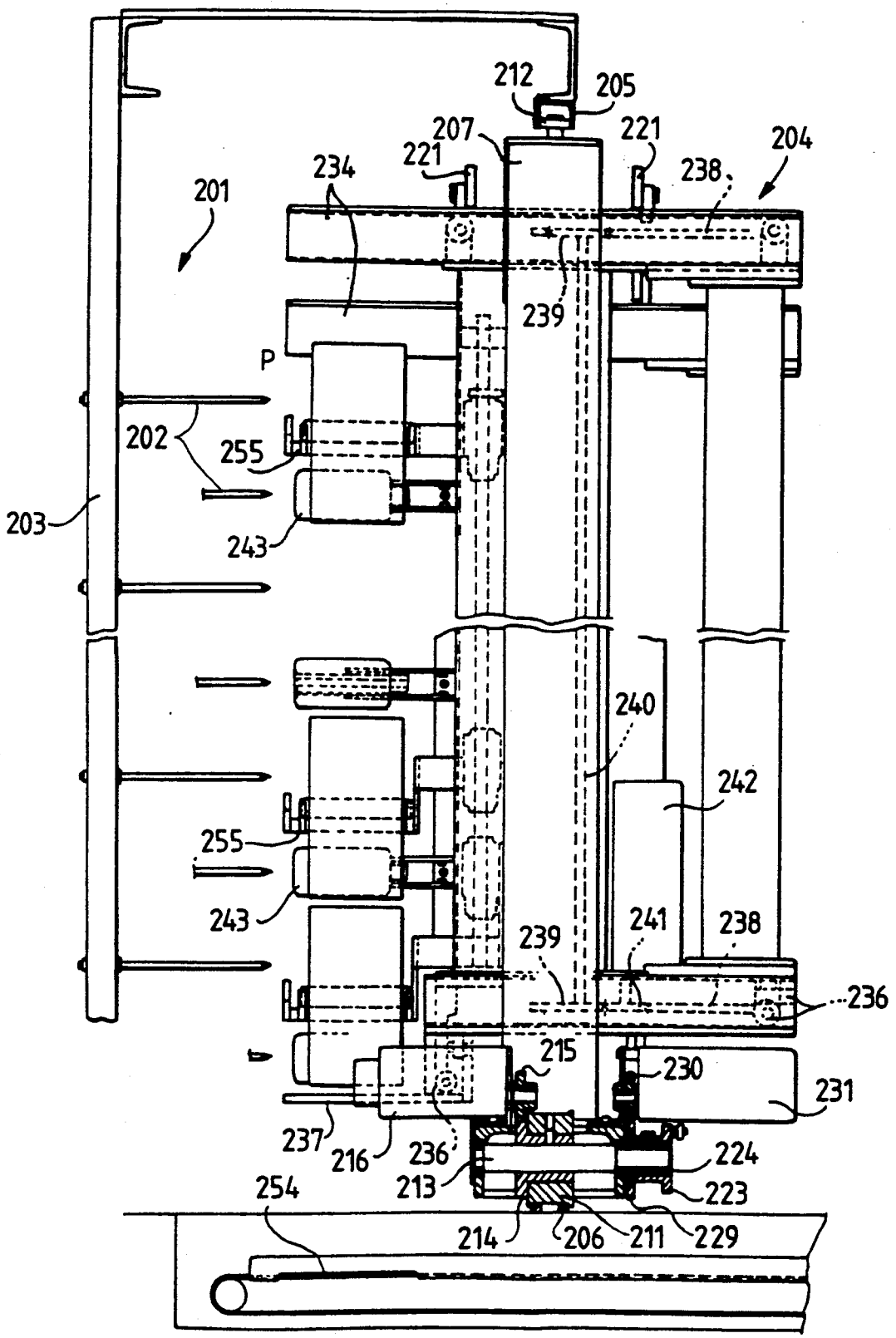
FIG. 14 is a side view of the robot.

The car truck 207 is formed in a rectangular frame form. Running wheels 211 for running on the single lower rail 206 are provided at front and rear positions on a lower portion of the car truck 207, whereas guide rollers 12 to be moved along the upper rail 205, which comprises a channel rail, are provided at front and rear positions on an upper portion of the car truck 207. A gear 214 is attached to an axle 213 for each of the running wheels 211, as shown in FIG. 14, and a running motor 216 having a driving wheel 215 for engagement with the gear 214 is mounted on the car truck 207.

Support shafts 217 and 218 are fitted to upper and lower portions of the car truck 207 through bearings 219 and 220, perpendicularly to the running direction. A pair of oscillating frames 221 and a pair of oscillating frames 222, which constitute part of the switching mechanism 210, are attached respectively to the upper and lower support shafts 217 and 218. Between both end portions of the upper and lower oscillating frames 221 and 222 opposed to each other, the pull-off unit 208 and the fitting unit 209 are fitted in parallel to each other, with a spacing therebetween equal to the arranging pitch of the pegs 202. In order to perform a switching operation for conforming the height of each of the units 208 and 209 to the pegs 202 in each row, a driving wheel 223 constituting a crank is rotatably mounted on the axle 213 for the running wheel 211, through a bearing 224. End portions of a connecting rod 226 are connected to the driving wheel 223 and to a bracket 225 projected on a lower central portion of the lower oscillating frame 222 through shafts 227 and 228, respectively. The driving wheel 223 is provided with a gear 229, and an oscillating motor 231 having a driving wheel 230 for engagement with the gear 229 is mounted on the car truck 207.

A switching stroke S for the oscillating frames 221 and 222 is set to be equal to the amount of vertical stagger between the rows of pegs 202 arranged in the staggered pattern. Proximity sensors 232 and 233 are disposed respectively at both stroke ends (dead centers) of the connecting rod 226 in the vicinity of the driving wheel 223, making it possible to stop the driving wheel 223 at each of switching points for the oscillating frames 221 and 222.

In order to support each of the units 208 and 209 movably toward and away from the pegs 202, channel guides 234 are fitted to both end portions of the oscillating frames 221 and 222 through shafts 235, and guide rollers 236 capable of rolling on bottom and both side surfaces of the channel guides 234 are fitted to upper and lower end portions of each of the units 208 and 209. To a front end portion on the peg side of the lower channel guide 234 of the fitting unit 236, an auxiliary guide 237 is fitted for rollably supporting the front one of the guide roller 236.

A rack 238 is attached to one side face of the channel guide 234, whereas a shaft 240 with a pair of upper and lower pinions 239 attached thereto for engagement with the respective racks 238 is rotatably supported on each of the units 208 and 209, and a unit-moving motor 242 having a driving gear 241 for engagement with the lower pinion 239 is mounted on each of the units 208 and 209.

Figure 15:
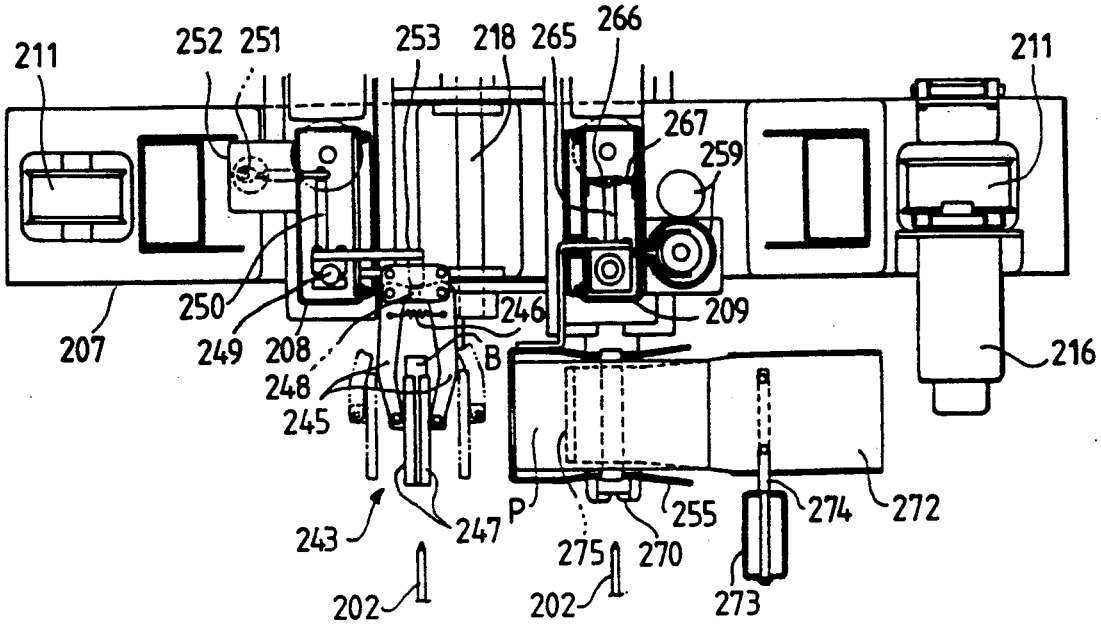
FIG. 15 is a plan view of the robot.

The pull-off unit 208 comprises clampers 243 for gripping the bobbins B with residual yarn thereon, which are fitted on the pegs 202, at a multiplicity of vertical levels corresponding to the pegs 202. As shown in FIG. 15, the clamper 243 comprises a pair of left and right arms 245 each of which is movably supported at a base end portion thereof by a bracket 244 fixed to the pull-off unit 208. Between the arms 245 is fitted a spring 246 for biasing the arms in a closing direction, and clamp pieces 247 for gripping the bobbin B with residual yarn thereon are fitted to tip portions of the arms 245. Base end portions of the arms 245 are L-shaped so as to intersect each other, and the clamper 243 is opened when the intersecting portion 248 is pressed. In order to open or close the clampers 243 simultaneously, a rotary shaft 249 is supported upright on the pull-off unit 208, a motor 252 having a crank 251 for turning the rotary shaft 249 through a link 250 is mounted on the unit 208, and the rotary shaft 249 is equipped with pressing pieces 253 for pressing the intersecting portions 248 of the clampers 243.

The bobbins B with residual yarn thereon which are pulled off by the clampers 243 are dropped onto a belt conveyor 254 disposed under the lower rail 206 at a preset stop position for the car truck, to be collected into one place.

The fitting unit 209 is equipped with fitting arms 255 for fitting the packages P onto the pegs 202 on the creel frames 203, at a multiplicity of vertical levels corresponding to the pegs 202 on the creel frames 203, and is provided with a lift mechanism 256 for moving the fitting arms 255 upward or downward simultaneously. The lift mechanism 256 comprises a lift shaft 257 supported to be movable vertically along the fitting unit 209, and a screw shaft 260 supported in parallel to the lift shaft 257 and driven to rotate by a motor 258 through a gear 259. A nut body 261 is screw-engaged with the screw shaft 260, and an operating arm 262 projected from the lift shaft 257 is connected to the nut body 260.

Support blocks 263 with the respective fitting arms 255 attached thereto are turnably mounted on the lift shaft 257 through bearings 264. The support blocks 263 are each provided with a guide arm 265 projected rearward, whereas the fitting unit 209 is provided with a guide slit 267 for guiding a guide roller 266 fitted to a tip portion of the guide arm 265, within the range of lifting motion. The guide slit 267 is opened gradually wider upward so as to enable horizontal oscillation of the fitting arm 255 at the time of positioning the arm to the peg 204.

The fitting arm 255 is U-shaped in plan view, open on the backward side with respect to the running direction, and is provided at both side top portions thereof with support portions 269 for fastening both bobbin end portions of the packages P. To a front end portion of the fitting arm 255, a positioning member 270 is fitted which has a V-groove 269 for fastening a tip portion of the peg 202. The packages P can be fitted onto the pegs 202 as follows. The fitting arms 255 in the condition of being located below the corresponding pegs 202 are moved to the front side until the positioning members 270 are brought to the position of the tip portions of the pegs 202. Then, the fitting arms 255 are moved upward to engage the V-grooves 269 with the tip portions of the pegs 202, thereby positioning the arms 255. Upon completion of the positioning, the fitting arms 255 are further moved to the front side, thereby fitting the packages P onto the pegs 202. After the packages P are fitted over the pegs 204, the fitting arms 255 are lowered to separate the packages P therefrom. The car truck 207 is moved forward to such a position that the fitting arms 255 do not interfere with the packages P on the pegs 202, and thereafter the fitting arms 255 are retracted.

At a start position of running of the robot 204, a package transfer apparatus 271 is provided for transferring the packages P, supplied from a package feed line (not shown), onto the fitting arms 255. The package transfer apparatus 271 comprises movable chutes 272 disposed at a multiplicity of vertical levels corresponding to the fitting arms 255 on the robot 204. Each of the movable chutes 272 is turnably fitted, through a horizontal support shaft 274, to a fixed frame 273 disposed vertically on one side of the chutes 272. The movable chutes 272 are connected together by a common operating rod, not shown, and are tilted simultaneously.

A tip portion of the movable chute 272 is extended to a position between side portions of the fitting arm 255, and a stopper portion 275 for fastening the package P is provided by bending the tip portion upward. The movable chute 272 is tilted from a waiting position in which the tip portion is at substantially the same level as the fitting arm 255, as indicated by solid lines in FIG. 13, to an operative position in which the tip portion is located below the fitting arm 255, as indicated by imaginary lines in FIG. 13, whereby both bobbin end portions of the package P fastened to the tip portion of the chute 272 are mounted on the support portions 268 of the fitting arm 255.

The system of the embodiment above operates as follows.

First, the robot 204 runs to the position of a predetermined creel frame 203, where one row of the bobbins B with residual yarn thereon are preliminarily pulled off by the pull-off unit 208. Then, fitting of the packages P onto the pegs 202 in the one row by the fitting unit 209 and pull-off of the bobbins B with residual yarn thereon in the next row by the pull-off unit 208 are simultaneously carried out. Subsequently, the robot 204 is returned to the start position of running thereof, where packages P are transferred onto the fitting arms 255. This cycle of operations is repeated.

When the robot 204 is stopped at the position of the pegs 202 on the creel 201 at which package replacement is to be carried out, the switching mechanism 210 is operated to switch the height of each of the units 208 and 209 so as to conform to the pegs 202 in each row. For instance, switching of the heights of the units 208 and 209 from the relationship shown in FIG. 13 to the reversed relationship can be carried out by rotating the driving wheel 223 half a turn by the oscillating motor 231. The rotational position of the driving wheel 223 is detected by the proximity sensors 232 and 233 disposed at the dead center positions, and the driving wheel 223 is stopped upon being rotated half a turn from one dead center position 232 to the other 233. The driving force of the driving wheel 223 is transmitted through the connecting rod 226 to the lower oscillating frames 222, which are switched from the left-down position to the right-down position, whereby the heights of the units 208 and 209 are simultaneously switched. In this condition, the pull-off of the bobbins B with residual yarn thereon and the fitting of the packages P are simultaneously carried out.

In the manner mentioned above, it is possible to replace easily the packages P on the pegs 202 arranged in the staggered pattern. Where the pegs 202 are arranged in a grid pattern (namely, at intersections of equally spaced horizontal lines and equally spaced vertical lines), package replacement can be performed by, for instance, switching the pull-off unit 208 to a height conforming to the corresponding pegs, carrying out the pull-off operation, then switching the fitting unit 209 to a height conforming to the corresponding pegs 202, and carrying out the fitting operation. Thus, it is possible to carry out replacement of packages P by the single robot 204, for both the pegs 202 arranged in the staggered pattern and the pegs 202 arranged in the grid pattern.

Besides, the crank motion adopted as means for oscillating the oscillating frames 221 and 222 ensures definite movements, and enables ideal acceleration and deceleration of a simple harmonic oscillation. Furthermore, the arrangement for stopping the rotation at the dead center positions ensures an enhanced accuracy of stoppage and an easy locking of the stopped condition, which has the merit that there is no need for an extra control system.

While the above embodiment has been explained referring to a package replacing robot for a warper, this device is, naturally, applicable to other package replacing robots, as well.

To sum up the aforementioned, according to this embodiment the height positions of the pull-off unit and the fitting unit are switchable according to the pegs in each row, and, accordingly, it is possible to replace packages easily, not only where the pegs are arranged in a grid pattern (namely, at intersections of equally spaced horizontal lines and equally spaced vertical lines) but also where the pegs are arranged in a staggered pattern.

An embodiment of a package transfer apparatus with an improved construction for transferring packages onto fitting arms of a package replacing robot used for a warper or the like will be illustrated hereinafter. A package transfer apparatus capable of transferring packages onto fitting arms of a package replacing robot, irrespective of the size of the packages in diameter is provided. The package transfer apparatus comprises a movable chute disposed at a start position of running of a package replacing robot capable of running along a creel, the robot comprising a fitting arm for supporting bobbin ends of a package and fitting the package onto a peg on the creel, and the movable chute functioning to transfer the package, supplied from a package supplying portion, onto the fitting arm through a downward displacement from the upper side of the fitting arm.

When the robot is returned to the start position of running thereof after completion of package replacement, the movable chute having received a package from a package supplying portion transfers the package onto the fitting arm through a downward displacement.

Since the package is thus transferred onto the fitting arm through a downward displacement from the upper side of the fitting arm, it is possible to transfer assuredly the package onto the fitting arm irrespectively of the size of the package in diameter.

Still another embodiment will now be described in detail below, based on the accompanying drawings.

Figure 20:
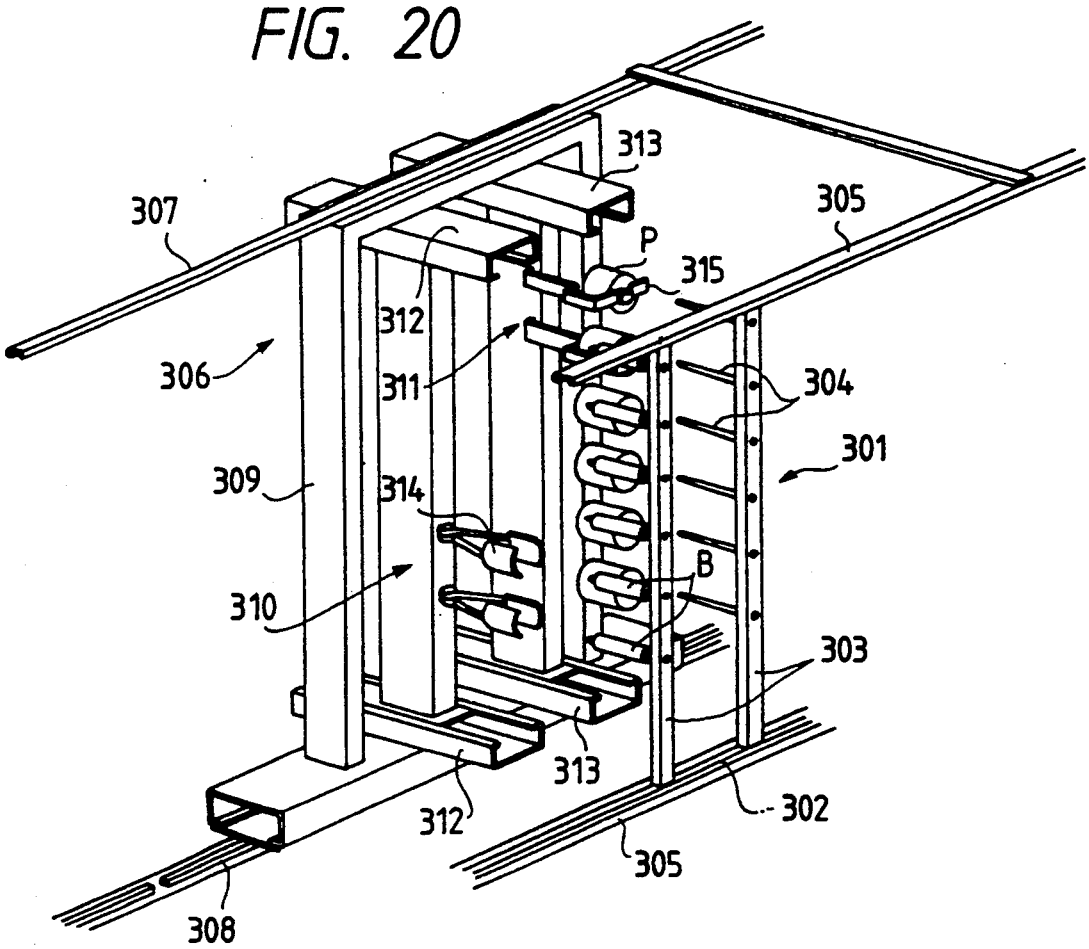
FIG. 20 is a perspective view of a package replacing robot for a warper.

Referring to FIG. 20, there is shown a circulative-type creel 301 for a warper, which comprises creel frames 303 fitted, at a predetermined pitch, between a pair of upper and lower endless chains 302 disposed horizontally through sprockets, not shown. On one side portion of each of the creel frames 303, pegs 304 for fitting packages P thereon are projected horizontally, at a multiplicity of vertical levels. Numeral 305 denotes rails for guiding the upper and lower endless chains 303.

On the peg projection side of the creel 301, a package replacing robot 306 is disposed to be capable of being reciprocated within a predetermined range along the direction of the circulative movement of the creel 301. The robot 306 comprises a car truck 309 supported to be capable of running along upper and lower rails 307, 308. The car truck 309 is equipped with a pull-off unit 310 for pulling off bobbins B with residual yarn thereon in a batch manner on the basis of the creel frame 303, and a fitting unit 311 for fitting the packages P in a batch manner on the basis of the creel frame 303. The pull-off unit 310 and the fitting unit 311 are disposed with a spacing therebetween equal to the pitch at which the creel frames 303 are arranged. The pull-off unit 310 and the fitting unit 311 are supported to be movable toward and away from the pegs 304 through upper and lower pairs of guides 312 and 313, the guides 312 being disposed on the forward side and the guides 313 on the backward side with respect to the running direction of the car truck 309.

The pull-off unit 310 comprises clampers 314 for gripping the bobbins B with residual yarn thereon, which are fitted on the pegs 304, at a multiplicity of vertical levels corresponding to the pegs 304 on the creel frame 303. The clampers 314 are simultaneously opened or closed by a driving mechanism, not shown. The bobbins B with residual yarn thereon which are pulled off by the clampers 314 are dropped onto a belt conveyor (not shown) provided along the lower rail 308, and are collected into one place.

Figure 18:
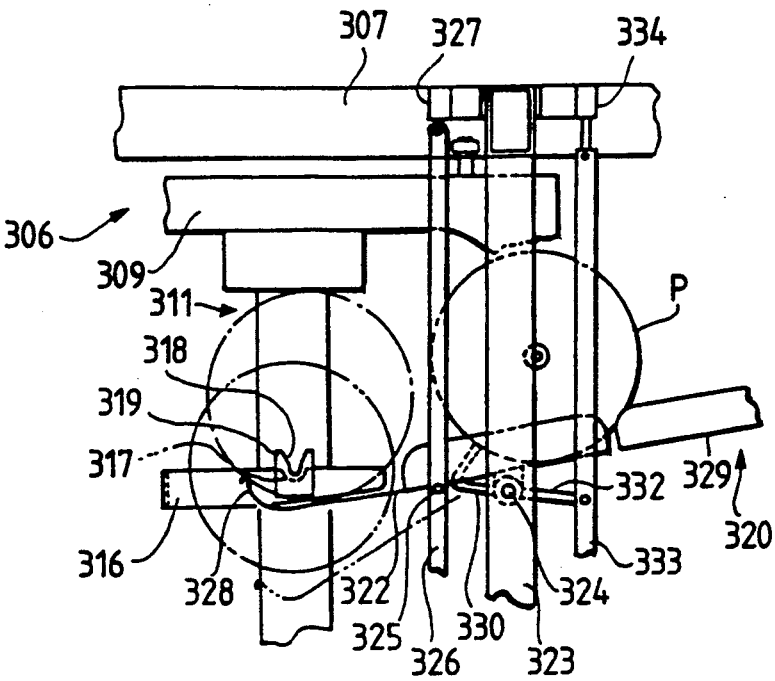
FIG. 18 is a side view of a package transfer apparatus illustrating still another embodiment of this invention.
Figure 19:
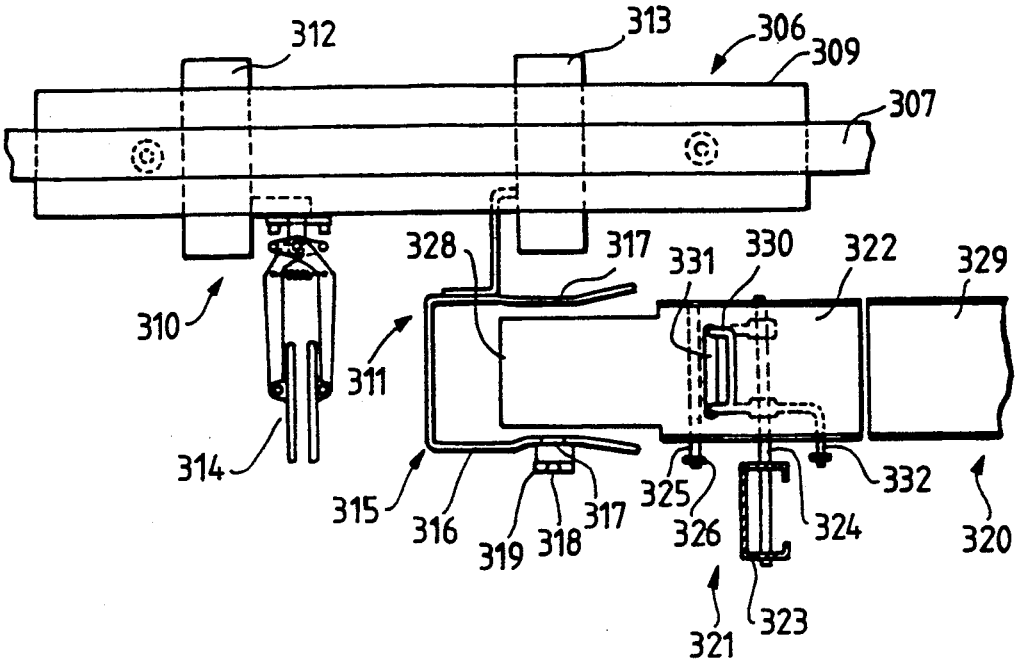
FIG. 19 is a plan view of the apparatus.

The fitting unit 311 is equipped with fitting arms 315 for fitting the packages P onto the pegs 304 on the creel frame 303, at a multiplicity of vertical levels corresponding to the pegs 304 on the creel frame 303. The fitting arms 315 are simultaneously moved upward or downward by a lift mechanism, not shown. As shown in FIGS. 18 and 19, the fitting arm 315 has a support frame portion 316 which, in plan view, is U-shaped and open on the backward side with respect to the running direction, and support portions 317 for fastening both bobbin end portions of the package P are provided at both side top portions of the support frame portion 316. At a front end portion of the support frame portion 316, a positioning member 319 is provided which has a V-groove 318 for fastening a tip portion of the peg 304.

The packages P can be fitted onto the pegs 304 as follows. The fitting arms 315 in the condition of being located below the corresponding pegs 304 are moved to the front side until the positioning members are brought to the position of the tip portions of the pegs 304. Then, the fitting arms 315 are moved upward to engage the V-groove 318 with the tip portions of the pegs 304, thereby positioning the fitting arms 315. Upon completion of the positioning, the fitting arms 315 are further moved to the front side, thereby fitting the packages P onto the pegs 304. After the packages P are fitted over the pegs 304, the fitting arms 315 are lowered to separate the packages P from the support frame portions 316. The car truck 309 is moved forward to such a position that the fitting arms 315 do not interfere with the packages P on the pegs 304, and thereafter the fitting arms 315 are retracted.

At a start position of running of the robot 306, a package transfer apparatus 321 is provided for transferring the packages P, supplied from a package supplying portion 320, onto the fitting arms 315. The package transfer apparatus 321 comprises movable chutes 323 disposed at a multiplicity of vertical levels corresponding to the fitting arms 315 on the robot 306 returned to the start position of running thereof. Each of the movable chutes 322 is turnably fitted, through a horizontal support shaft 324, to a fixed frame 323 disposed vertically on one side of the chutes 322, and is supported oscillatably on the support shaft 324.

In order to tilt the movable chutes 322 simultaneously, shafts 325 projected to one side of the chutes 322 are connected to a common operating rod 326, to which is connected a cylinder 327 for driving the rod 326 upward and downward. The movable chute 322 has such a width as to permit the package P to roll thereon. A tip portion of the movable chute 322 is extended to a position between the side portions of the support frame portion 316, and a stopper portion 328 for fastening the package P is provided by bending the tip portion upward. The movable chute 322 is tilted from a waiting position in which the tip portion is at substantially the same level as the support frame portion 316, as indicated by solid lines in FIG. 18, to an operative position in which the tip portion is located below the support frame portion 316, as indicated by imaginary lines in FIG. 18, whereby both bobbin end portions of the package P fastened to the tip portion of the chute 322 are mounted on the support portions 317 of the support frame portion of the fitting arm 315.

The movable chute 322 in the waiting position thereof is supported with a little inclination to permit the package P to roll thereon to the stopper portion 328. At the position of an upper end portion of each movable chute 322, a fixed chute 329 is disposed which constitutes part of the package supplying portion 320. The fixed chutes 329 are each supplied with packages P from a package feed line, not shown. The movable chute 322 is provided with a movable stopper 330 by which the package P supplied from the fixed chute 329 is temporarily kept waiting. The movable stopper 330 is turnably fitted to the above-mentioned support shaft 324, and is protruded and retracted through an opening portion 331 provided in the movable chute 322. In order to operate the movable stoppers 330 simultaneously, operating arms 330 connected respectively to the stoppers 330 are connected to a common operating rod 333, to which is coupled a cylinder 334 for driving the rod 333 upward and downward.

The system of the embodiment mentioned above operates as follows.

First, the robot 306 runs to the position of a predetermined creel frame 303, where one row of the bobbins B with residual yarn thereon are preliminarily pulled off by the pull-off unit 310. Then, fitting of the packages P onto the pegs 304 in the one row by the fitting unit 311 and pull-off of the bobbins B with residual yarn thereon in the next row by the pull-off unit 310 are simultaneously carried out. Subsequently, the robot 306 is returned to the start position of running, where packages P are transferred onto the fitting arms 315. This cycle of operations is repeated.

In the package transfer apparatus 321, the movable chutes 322 in the waiting position support thereon the packages P supplied from the fixed chutes 329. Of the packages P on each of the movable chutes 322, the preceding one P is fastened by the stopper portion 328 at the tip portion of the chute 322 whereas the succeeding one P is fastened by the movable stopper 330. After package replacement is finished, the robot 306 is returned to the start position of running thereof, upon which the movable chutes 322 are simultaneously tilted to the operative position thereof by the operating rod 326, whereby the package P on each of the movable chutes 322 is transferred onto the fitting arm 315 so that both bobbin end portions of the packages P are fastened by the support portions 317 of the support frame portion 316 of the arm 315.

Since the packages P are transferred onto the fitting arms 315 through downward displacement from the upper side of the arms 315, it is possible to transfer assuredly the packages P onto the fitting arms 315 irrespectively of the size of the packages P in diameter.

While the above embodiment has been explained referring to a package replacing robot for a warper, this device is, naturally, applicable to other package replacing robots, as well.

To sum up the aforementioned, according to this device the packages are transferred from the movable chutes onto the fitting arms of the package replacing robot through downward displacement from the upper side of the arms, so that it is possible to transfer the packages onto the fitting arms irrespectively of the size of the packages in diameter.

What is claimed is:

1. A package replacing apparatus comprising:

a plurality of support frames for supporting a plurality of pegs, fitting at least one package onto at least one of the plurality of pegs, the at least one package including a bobbin having a substantially cylindrical core and the at least one peg defining a substantially cylindrical axis, means for positioning the fitting means in spaced relationship with the support frame, pull-off means for removing bobbins from the plurality of pegs, means for positioning the pull-off means relative to the support frame, the fitting means comprising axis alignment means for moving the at least one package toward the at least one peg and for guiding the at least one peg toward the substantially cylindrical core of the bobbin to thereby align the substantially cylindrical core of the bobbin with the axis of the at least one peg, a first carriage for movably supporting the fitting means and the axis alignment means, the first carriage including moving means for moving the first carriage between at least first and second support frames of the plurality of support frames, wherein the fitting means includes a vertically movable rod supported on the first carriage, a sleeve vertically movable and rotatably disposed on the vertically movable rod, a package support member supported by the sleeve and having a pair of opposing support arms having recesses formed in respective upper surfaces thereof for receiving and supporting the at least one package.

2. The package replacing apparatus according to claim 1, wherein the axis alignment means includes a peg support member provided with a V-shaped notch for receiving the at least one peg, the peg support member being disposed on one of the opposing support arms of the package support member, wherein the axis of the at least one package supported by the opposing support arms and an axis the at least one peg received in the V-shaped notch coincide when the at least one peg is fully received in the V-shaped notch.

3. The package replacing apparatus as claimed in claim 1, further including a second carriage for movably supporting the pull-off device, the second carriage including moving means for moving the second carriage between at least the first and second support frames, wherein the pull-off means includes a plurality of robot hands, each of the robot hands including a pair of swing members pivotably supported on a pivot pin, a spring biasing the swing members toward each other, each swing member movably supporting a bobbin holding member with respective pivot pins, respectively, and a robot hand operating mechanism.

4. The package replacing apparatus as claimed in claim 3, wherein the second carriage including a chute disposed under each robot hand for receiving empty bobbins removed from the plurality of pegs.

* * * * *